US009638121B2

(12) United States Patent
Rayl

(10) Patent No.: US 9,638,121 B2
(45) Date of Patent: May 2, 2017

(54) SYSTEM AND METHOD FOR DEACTIVATING A CYLINDER OF AN ENGINE AND REACTIVATING THE CYLINDER BASED ON AN ESTIMATED TRAPPED AIR MASS

(71) Applicant: GM GLOBAL TECHNOLOGY OPERATIONS LLC, Detroit, MI (US)

(72) Inventor: Allen B. Rayl, Waterford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 323 days.

(21) Appl. No.: 13/798,451

(22) Filed: Mar. 13, 2013

(65) Prior Publication Data

US 2014/0053803 A1 Feb. 27, 2014

Related U.S. Application Data

(60) Provisional application No. 61/693,023, filed on Aug. 24, 2012.

(51) Int. Cl.

| | |
|---|---|
| ***F02D 41/00*** | (2006.01) |
| ***F02D 35/02*** | (2006.01) |
| ***F02D 37/02*** | (2006.01) |

(52) U.S. Cl.

CPC ..... *F02D 41/0087* (2013.01); *F02D 35/024* (2013.01); *F02D 37/02* (2013.01); *F02D 2041/0012* (2013.01)

(58) Field of Classification Search

CPC ..... F02D 41/0087; F02D 13/06; F02D 2041/0012; F02D 41/0082; F02D 41/008; F02D 37/02; F02D 41/021; F02D 41/1498; F02D 41/3058; F02D 17/00; F02D 17/02; F02D 2041/1432; F02D 2200/025;

(Continued)

(56) References Cited

U.S. PATENT DOCUMENTS

| | | | |
|---|---|---|---|
| 3,596,640 | A | 8/1971 | Bloomfield |
| 4,129,034 | A | 12/1978 | Niles et al. |
| 4,172,434 | A | 10/1979 | Coles |

(Continued)

FOREIGN PATENT DOCUMENTS

| | | | |
|---|---|---|---|
| CN | 1573916 | A | 2/2005 |
| CN | 1888407 | A | 1/2007 |

(Continued)

OTHER PUBLICATIONS

U.S. Appl. No. 61/952,737, filed Mar. 13, 2014, Shost et al.

(Continued)

*Primary Examiner* — Hung Q Nguyen
*Assistant Examiner* — John Bailey

(57) ABSTRACT

A system according to the principles of the present disclosure includes a cylinder activation module and a spark control module. The cylinder activation module selectively deactivates and reactivates a cylinder of an engine. The cylinder activation module deactivates the cylinder after intake air is drawn into the cylinder and before fuel is injected into the cylinder or spark is generated in the cylinder. When the cylinder is reactivated, the spark control module selectively controls a spark plug to generate spark in the cylinder before an intake valve or an exhaust valve of the cylinder is opened.

20 Claims, 4 Drawing Sheets

(58) Field of Classification Search
CPC F02D 2250/28; Y02T 10/46; F01L 2013/001; F02N 99/004; F02P 5/1512
USPC ..... 123/350, 329, 339.11, 406.11, 406.14, 123/406.19, 406.44, 406.57, 406.72, 123/406.76, 596, 620, 627, 636, 637, 638, 123/639, 645, 146.5 R, 179.5, 406, 406.2, 123/406.21, 406.22, 406.23, 406.24, 123/406.25, 406.26, 406.27, 406.41, 435, 123/673, 691, 692, 481, 643, 198 DC, 123/198 F
See application file for complete search history.

(56) References Cited

U.S. PATENT DOCUMENTS 4,377,997 A * 3/1983 Staerzl ..... F02P 1/086 123/406.29
4,434,767 A 3/1984 Kohama et al.
4,489,695 A 12/1984 Kohama et al.
4,509,488 A * 4/1985 Forster ..... F02D 41/0087 123/198 F
4,535,744 A * 8/1985 Matsumura ..... F02D 17/02 123/325
4,770,148 A * 9/1988 Hibino ..... F02D 41/005 123/435
4,887,216 A 12/1989 Ohnari et al.
4,974,563 A 12/1990 Ikeda et al.
4,987,888 A 1/1991 Funabashi et al.
5,042,444 A * 8/1991 Hayes ..... F02D 17/02 123/198 F
5,094,213 A * 3/1992 Dudek ..... F02D 37/00 123/339.27
5,226,513 A * 7/1993 Shibayama ..... F16H 61/143 192/3.3
5,278,760 A 1/1994 Ribbens et al.
5,357,932 A * 10/1994 Clinton ..... F02D 13/0219 123/478
5,374,224 A * 12/1994 Huffmaster ..... F02D 37/02 123/198 F
5,377,631 A * 1/1995 Schechter ..... F01L 9/02 123/198 F
5,423,208 A * 6/1995 Dudek ..... F02D 41/045 123/478
5,465,617 A * 11/1995 Dudek ..... F02D 41/18 73/1.34
5,496,227 A 3/1996 Minowa et al.
5,540,633 A 7/1996 Yamanaka et al.
5,553,575 A 9/1996 Beck et al.
5,584,266 A 12/1996 Motose et al.
5,669,354 A * 9/1997 Morris ..... F02D 41/1498 123/406.24
5,692,471 A 12/1997 Zhang
5,720,257 A 2/1998 Motose et al.
5,778,858 A 7/1998 Garabedian
5,813,383 A * 9/1998 Cummings ..... F01L 1/146 123/145 A
5,884,605 A * 3/1999 Nagaishi ..... F02P 5/1521 123/339.11
5,909,720 A * 6/1999 Yamaoka ..... B60K 6/365 123/179.3
5,931,140 A * 8/1999 Maloney ..... F02D 41/0072 123/480
5,934,263 A * 8/1999 Russ ..... F01L 1/34 123/568.14
5,941,927 A 8/1999 Pfitz
5,974,870 A 11/1999 Treinies et al.
5,975,052 A 11/1999 Moyer
5,983,867 A * 11/1999 Stuber ..... F02D 41/04 123/478
6,125,812 A 10/2000 Garabedian
6,158,411 A 12/2000 Morikawa
6,244,242 B1 6/2001 Grizzle et al.
6,247,449 B1 6/2001 Persson
6,272,427 B1 * 8/2001 Wild ..... F02D 41/04 123/568.11
6,286,366 B1 * 9/2001 Chen ..... F02D 41/32 73/114.31
6,295,500 B1 9/2001 Cullen et al.
6,332,446 B1 12/2001 Matsumoto et al.
6,334,425 B1 * 1/2002 Nagatani ..... F02D 41/1456 123/295
6,355,986 B1 * 3/2002 Kato ..... F16F 15/03 123/179.3
6,360,724 B1 * 3/2002 Suhre ..... F02D 17/02 123/198 F
6,363,316 B1 3/2002 Soliman et al.
6,371,075 B2 * 4/2002 Koch ..... F01L 9/04 123/198 F
6,385,521 B1 5/2002 Ito
6,408,625 B1 6/2002 Woon et al.
6,520,140 B2 2/2003 Dreymuller et al.
6,546,912 B2 4/2003 Tuken
6,588,261 B1 7/2003 Wild et al.
6,619,258 B2 9/2003 McKay et al.
6,622,548 B1 * 9/2003 Hernandez ..... F02D 41/1447 73/114.31
6,694,806 B2 2/2004 Kumagai et al.
6,738,707 B2 5/2004 Kotwicki et al.
6,754,577 B2 6/2004 Gross et al.
6,760,656 B2 * 7/2004 Matthews ..... F02D 41/0087 123/480
6,850,831 B2 2/2005 Buckland et al.
6,909,961 B2 6/2005 Wild et al.
6,978,204 B2 * 12/2005 Surnilla ..... F02P 5/1504 123/325
6,980,902 B2 12/2005 Nakazawa
6,981,492 B2 1/2006 Barba et al.
6,983,737 B2 * 1/2006 Gross ..... F02D 35/025 123/435
7,003,390 B2 2/2006 Kaga
7,024,301 B1 * 4/2006 Kar ..... F02D 35/025 123/478
7,025,041 B2 4/2006 Abe et al.
7,028,661 B1 * 4/2006 Bonne ..... F02D 17/02 123/198 F
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 6/2006 Michelini et al.
7,066,136 B2 6/2006 Ogiso
7,069,718 B2 * 7/2006 Surnilla ..... F01N 13/011 123/198 F
7,069,773 B2 7/2006 Stempnik et al.
7,086,386 B2 8/2006 Doering
7,100,720 B2 * 9/2006 Ishikawa ..... B60K 6/485 180/65.26
7,111,612 B2 9/2006 Michelini et al.
7,140,355 B2 11/2006 Michelini et al.
7,159,568 B1 1/2007 Lewis et al.
7,174,713 B2 2/2007 Nitzke et al.
7,174,879 B1 * 2/2007 Chol ..... F02D 31/002 123/406.11
7,200,486 B2 * 4/2007 Tanaka ..... F02D 11/105 701/103
7,203,588 B2 4/2007 Kaneko et al.
7,231,907 B2 6/2007 Bolander et al.
7,278,391 B1 10/2007 Wong et al.
7,292,231 B2 * 11/2007 Kodama ..... G03G 15/326 345/173
7,292,931 B2 * 11/2007 Davis ..... F02D 41/18 701/102
7,319,929 B1 * 1/2008 Davis ..... F02D 41/18 123/361
7,363,111 B2 * 4/2008 Vian ..... G05B 23/024 700/279
7,367,318 B2 5/2008 Moriya et al.
7,415,345 B2 8/2008 Wild
7,440,838 B2 10/2008 Livshiz et al.

(56) References Cited

U.S. PATENT DOCUMENTS 7,464,676 B2 * 12/2008 Wiggins ..... F01L 1/344 123/90.15
7,472,014 B1 12/2008 Albertson et al.
7,497,074 B2 * 3/2009 Surnilla ..... F02D 41/0087 123/520
7,499,791 B2 3/2009 You et al.
7,503,312 B2 3/2009 Surnilla et al.
7,509,201 B2 3/2009 Bolander et al.
7,555,896 B2 7/2009 Lewis et al.
7,577,511 B1 * 8/2009 Tripathi ..... F02D 41/0087 701/103
7,581,531 B2 * 9/2009 Schulz ..... F02D 41/0087 123/198 DB
7,614,384 B2 11/2009 Livshiz et al.
7,620,188 B2 11/2009 Inoue et al.
7,621,262 B2 * 11/2009 Zubeck ..... B60K 6/442 123/543
7,634,349 B2 12/2009 Senft et al.
7,685,976 B2 * 3/2010 Marriott ..... F02D 13/0215 123/348
7,785,230 B2 * 8/2010 Gibson ..... B60W 30/20 477/101
7,836,866 B2 11/2010 Luken et al.
7,849,835 B2 12/2010 Tripathi et al.
7,886,715 B2 2/2011 Tripathi et al.
7,930,087 B2 * 4/2011 Gibson ..... F02D 13/04 123/321
7,946,263 B2 * 5/2011 O'Neill ..... F01L 1/143 123/295
7,954,474 B2 6/2011 Tripathi et al.
8,050,841 B2 11/2011 Costin et al.
8,099,224 B2 1/2012 Tripathi et al.
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 * 4/2012 Leone ..... F02D 41/0087 123/198 F
8,272,367 B2 * 9/2012 Shikama ..... F02D 11/105 123/406.24
8,347,856 B2 1/2013 Leone et al.
8,402,942 B2 3/2013 Tripathi et al.
8,473,179 B2 6/2013 Whitney et al.
8,616,181 B2 12/2013 Sahandiesfanjani et al.
8,646,430 B2 * 2/2014 Kinoshita ..... B63B 35/731 123/198 DB
8,646,435 B2 2/2014 Dibble et al.
8,701,628 B2 4/2014 Tripathi et al.
8,706,383 B2 4/2014 Sauve et al.
8,833,058 B2 * 9/2014 Ervin ..... F02D 41/0245 60/274
8,833,345 B2 9/2014 Pochner et al.
8,869,773 B2 10/2014 Tripathi et al.
8,979,708 B2 3/2015 Burtch
9,020,735 B2 4/2015 Tripathi et al.
9,140,622 B2 9/2015 Beikmann
9,200,575 B2 12/2015 Shost
9,212,610 B2 12/2015 Chen et al.
9,222,427 B2 12/2015 Matthews et al.
2001/0007964 A1 7/2001 Poljansek et al.
2002/0038654 A1 4/2002 Sasaki et al.
2002/0039950 A1 4/2002 Graf et al.
2002/0156568 A1 10/2002 Knott et al.
2002/0162540 A1 11/2002 Matthews et al.
2002/0189574 A1 12/2002 Kim
2003/0116130 A1 6/2003 Kisaka et al.
2003/0123467 A1 7/2003 Du et al.
2003/0131820 A1 * 7/2003 Mckay ..... F01L 13/0005 123/198 F
2003/0172892 A1 * 9/2003 Glugla ..... F02B 75/22 123/179.5
2003/0172900 A1 * 9/2003 Boyer ..... F01L 1/34 123/198 F
2003/0217877 A1 * 11/2003 Tatara ..... B60K 6/387 180/65.26
2003/0236599 A1 * 12/2003 Saito ..... B60K 6/485 701/22
2004/0007211 A1 1/2004 Kobayashi
2004/0034460 A1 2/2004 Folkerts et al.
2004/0069290 A1 4/2004 Bucktron et al.
2004/0122584 A1 6/2004 Muto et al.
2004/0129249 A1 7/2004 Kondo
2004/0138027 A1 7/2004 Rustige et al.
2004/0206072 A1 10/2004 Surnilla et al.
2004/0258251 A1 12/2004 Inoue et al.
2005/0016492 A1 * 1/2005 Matthews ..... F02D 17/02 123/198 F
2005/0056250 A1 3/2005 Stroh
2005/0098156 A1 5/2005 Ohtani
2005/0131618 A1 * 6/2005 Megli ..... F02D 13/0215 701/101
2005/0197761 A1 * 9/2005 Bidner ..... F02P 5/045 701/105
2005/0199220 A1 9/2005 Ogiso
2005/0204726 A1 * 9/2005 Lewis ..... F02D 13/06 60/285
2005/0204727 A1 * 9/2005 Lewis ..... F01L 9/04 60/285
2005/0205028 A1 * 9/2005 Lewis ..... F02D 13/06 123/90.11
2005/0205045 A1 * 9/2005 Michelini ..... F02D 13/06 123/198 F
2005/0205060 A1 * 9/2005 Michelini ..... F01L 1/36 123/432
2005/0205063 A1 * 9/2005 Kolmanovsky ..... F01L 9/04 123/436
2005/0205069 A1 * 9/2005 Lewis ..... F01L 1/38 123/491
2005/0205074 A1 * 9/2005 Gibson ..... F02D 13/0207 123/673
2005/0235743 A1 * 10/2005 Stempnik ..... F02D 11/105 73/114.32
2006/0107919 A1 * 5/2006 Nishi ..... F02D 13/06 123/198 F
2006/0112918 A1 * 6/2006 Persson ..... F01L 1/181 123/90.16
2006/0130814 A1 6/2006 Bolander et al.
2006/0178802 A1 8/2006 Bolander et al.
2007/0012040 A1 * 1/2007 Nitzke ..... F02D 41/0007 60/605.2
2007/0042861 A1 * 2/2007 Takaoka ..... B60K 6/365 477/3
2007/0051351 A1 3/2007 Pallett et al.
2007/0100534 A1 * 5/2007 Katsumata ..... F02D 35/023 701/103
2007/0101969 A1 5/2007 Lay et al.
2007/0107692 A1 * 5/2007 Kuo ..... F02B 23/0672 123/305
2007/0131169 A1 * 6/2007 Ahn ..... C23C 16/45525 118/715
2007/0131196 A1 6/2007 Gibson et al.
2007/0135988 A1 6/2007 Kidston et al.
2007/0235005 A1 * 10/2007 Lewis ..... F01L 9/04 123/322
2008/0000149 A1 * 1/2008 Aradi ..... C10L 1/00 44/359
2008/0041327 A1 2/2008 Lewis et al.
2008/0066699 A1 * 3/2008 Michelini ..... F02D 13/0253 123/90.11
2008/0098969 A1 5/2008 Reed et al.
2008/0109151 A1 5/2008 Jaros et al.
2008/0121211 A1 * 5/2008 Livshiz ..... F02D 41/18 123/349
2008/0154468 A1 * 6/2008 Berger ..... B60K 6/365 701/54
2008/0254926 A1 * 10/2008 Schuseil ..... F01L 1/024 474/111
2008/0262698 A1 10/2008 Lahti et al.

(56) References Cited

U.S. PATENT DOCUMENTS

2008/0288146 A1* 11/2008 Beechie ..... B60W 10/023 701/58
2009/0007877 A1 1/2009 Raiford
2009/0013667 A1 1/2009 Winstead
2009/0013668 A1 1/2009 Winstead
2009/0013669 A1* 1/2009 Winstead ..... F02M 26/43 60/278
2009/0013969 A1 1/2009 Winstead
2009/0018746 A1 1/2009 Miller et al.
2009/0030594 A1* 1/2009 You ..... F02D 41/042 701/112
2009/0042458 A1* 2/2009 Kinoshita ..... B63B 35/731 440/1
2009/0042463 A1 2/2009 Kinoshita
2009/0118914 A1 5/2009 Schwenke et al.
2009/0118965 A1* 5/2009 Livshiz ..... F02D 11/105 701/101
2009/0118968 A1* 5/2009 Livshiz ..... F02D 11/105 701/102
2009/0118975 A1 5/2009 Murakami et al.
2009/0118986 A1 5/2009 Kita
2009/0177371 A1* 7/2009 Reinke ..... F02D 17/04 701/111
2009/0204312 A1 8/2009 Moriya
2009/0229562 A1* 9/2009 Ramappan ..... F02B 1/14 123/295
2009/0241872 A1 10/2009 Wang et al.
2009/0248277 A1* 10/2009 Shinagawa ..... F02D 13/0238 701/103
2009/0248278 A1* 10/2009 Nakasaka ..... F02D 13/0238 701/103
2009/0292435 A1* 11/2009 Costin ..... F02D 41/0087 701/84
2010/0006065 A1* 1/2010 Tripathi ..... F02D 41/0087 123/350
2010/0010724 A1* 1/2010 Tripathi ..... F02D 41/0087 701/103
2010/0012072 A1 1/2010 Leone et al.
2010/0030447 A1 2/2010 Smyth et al.
2010/0036571 A1 2/2010 Han et al.
2010/0042308 A1 2/2010 Kobayashi et al.
2010/0050993 A1 3/2010 Zhao et al.
2010/0057283 A1* 3/2010 Worthing ..... F02D 41/1497 701/22
2010/0059004 A1* 3/2010 Gill ..... F02B 29/083 123/90.11
2010/0100299 A1* 4/2010 Tripathi ..... F02D 41/0087 701/102
2010/0107630 A1* 5/2010 Hamama ..... F02B 37/001 60/602
2010/0192925 A1* 8/2010 Sadakane ..... F01L 1/34 123/520
2010/0211299 A1 8/2010 Lewis et al.
2010/0222989 A1 9/2010 Nishimura
2010/0282202 A1 11/2010 Luken
2010/0318275 A1* 12/2010 Borchsenius ..... F02D 41/3809 701/102
2011/0005496 A1 1/2011 Hiraya et al.
2011/0030657 A1* 2/2011 Tripathi ..... F02D 17/02 123/481
2011/0048372 A1* 3/2011 Dibble ..... F02D 41/0087 123/350
2011/0088661 A1 4/2011 Sczomak et al.
2011/0094475 A1 4/2011 Riegel et al.
2011/0107986 A1 5/2011 Winstead
2011/0118955 A1 5/2011 Livshiz et al.
2011/0144883 A1* 6/2011 Rollinger ..... F02D 13/06 701/102
2011/0178693 A1 7/2011 Chang et al.
2011/0208405 A1* 8/2011 Tripathi ..... F02D 17/02 701/102
2011/0213526 A1 9/2011 Giles et al.
2011/0213540 A1* 9/2011 Tripathi ..... F02D 37/02 701/102
2011/0213541 A1 9/2011 Tripathi et al.
2011/0251773 A1 10/2011 Sahandiesfanjani et al.
2011/0264342 A1 10/2011 Baur et al.
2011/0265454 A1* 11/2011 Smith ..... F01N 3/0842 60/274
2011/0265771 A1* 11/2011 Banker ..... F01N 3/0814 123/564
2011/0295483 A1 12/2011 Ma et al.
2011/0313643 A1* 12/2011 Lucatello ..... F02D 13/0261 701/112
2012/0029787 A1 2/2012 Whitney et al.
2012/0055444 A1* 3/2012 Tobergte ..... F02D 13/06 123/294
2012/0103312 A1 5/2012 Sasai et al.
2012/0109495 A1* 5/2012 Tripathi ..... F02D 41/30 701/102
2012/0116647 A1* 5/2012 Pochner ..... F02D 17/02 701/102
2012/0143471 A1* 6/2012 Tripathi ..... F02D 28/00 701/102
2012/0180759 A1 7/2012 Whitney et al.
2012/0221217 A1* 8/2012 Sujan ..... B60W 10/06 701/54
2012/0285161 A1* 11/2012 Kerns ..... F02D 41/0087 60/598
2013/0092127 A1 4/2013 Pirjaberi et al.
2013/0092128 A1* 4/2013 Pirjaberi ..... F02D 41/0087 123/406.23
2013/0184949 A1 7/2013 Saito et al.
2013/0289853 A1 10/2013 Serrano
2014/0041625 A1 2/2014 Pirjaberi et al.
2014/0041641 A1 2/2014 Carlson et al.
2014/0053802 A1 2/2014 Rayl
2014/0053804 A1 2/2014 Rayl et al.
2014/0053805 A1 2/2014 Brennan et al.
2014/0069178 A1 3/2014 Beikmann
2014/0069374 A1 3/2014 Matthews
2014/0069375 A1 3/2014 Matthews et al.
2014/0069376 A1 3/2014 Matthews et al.
2014/0069377 A1 3/2014 Brennan et al.
2014/0069378 A1 3/2014 Burleigh et al.
2014/0069379 A1 3/2014 Beikmann
2014/0069381 A1 3/2014 Beikmann
2014/0090623 A1 4/2014 Beikmann
2014/0090624 A1* 4/2014 Verner ..... F02D 41/0087 123/406.12
2014/0102411 A1 4/2014 Brennan
2014/0190448 A1 7/2014 Brennan et al.
2014/0190449 A1 7/2014 Phillips
2014/0194247 A1 7/2014 Burtch
2014/0207359 A1 7/2014 Phillips
2015/0240671 A1 8/2015 Nakamura
2015/0260112 A1 9/2015 Liu et al.
2015/0260117 A1 9/2015 Shost et al.
2015/0354470 A1 12/2015 Li et al.
2015/0361907 A1 12/2015 Hayman et al.

FOREIGN PATENT DOCUMENTS

CN 101220780 A 7/2008
CN 101353992 A 1/2009
CN 101476507 A 7/2009
CN 101586504 A 11/2009
CN 102454493 A 5/2012
EP 1489595 A2 12/2004
JP 2010223019 A 10/2010
JP 2011149352 A 8/2011

OTHER PUBLICATIONS

U.S. Appl. No. 13/798,518, filed Mar. 13, 2013, Beikmann.
U.S. Appl. No. 13/799,116, filed Mar. 13, 2013, Brennan.
U.S. Appl. No. 13/798,384, filed Mar. 13, 2013, Burtch.
U.S. Appl. No. 14/734,619, filed Jun. 9, 2015, Matthews.
International Search Report and Written Opinion dated Jun. 17,

(56) References Cited

OTHER PUBLICATIONS 2015 corresponding to International Application No. PCT/US2015/019496, 14 pages.
U.S. Appl. No. 13/798,351, filed Mar. 13, 2013, Rayl.
U.S. Appl. No. 13/798,400, filed Mar. 13, 2013, Phillips.
U.S. Appl. No. 13/798,435, filed Mar. 13, 2013, Matthews.
U.S. Appl. No. 13/798,471, filed Mar. 13, 2013, Matthews et al.
U.S. Appl. No. 13/798,536, filed Mar. 13, 2013, Matthews et al.
U.S. Appl. No. 13/798,540, filed Mar. 13, 2013, Brennan et al.
U.S. Appl. No. 13/798,574, filed Mar. 13, 2013, Verner.
U.S. Appl. No. 13/798,586, filed Mar. 13, 2013, Rayl et al.
U.S. Appl. No. 13/798,590, filed Mar. 13, 2013, Brennan et al.
U.S. Appl. No. 13/798,624, filed Mar. 13, 2013, Brennan et al.
U.S. Appl. No. 13/798,701, filed Mar. 13, 2013, Burleigh et al.
U.S. Appl. No. 13/798,737, filed Mar. 13, 2013, Beikmann.
U.S. Appl. No. 13/798,775, filed Mar. 13, 2013, Phillips.
U.S. Appl. No. 13/799,129, filed Mar. 13, 2013, Beikmann.
U.S. Appl. No. 13/799,181, filed Mar. 13, 2013, Beikmann.
U.S. Appl. No. 14/143,267, filed Dec. 30, 2013, Gehringer et al.
U.S. Appl. No. 14/211,389, filed Mar. 14, 2014, Liu et al.
U.S. Appl. No. 14/300,469, filed Jun. 10, 2014, Li et al.
U.S. Appl. No. 14/310,063, filed Jun. 20, 2014, Wagh et al.
U.S. Appl. No. 14/449,726, filed Aug. 1, 2014, Hayman et al.
U.S. Appl. No. 14/548,501, filed Nov. 20, 2014, Beikmann et al.
U.S. Appl. No. 14/638,908, filed Mar. 4, 2015, Shost et al.
Glossary of Judicial Claim Constructions in the Electronics, Computer and Business Method Arts. Public Patent Foundation. (2010).

* cited by examiner

SYSTEM AND METHOD FOR DEACTIVATING A CYLINDER OF AN ENGINE AND REACTIVATING THE CYLINDER BASED ON AN ESTIMATED TRAPPED AIR MASS

CROSS-REFERENCE TO RELATED APPLICATIONS

This application claims the benefit of U.S. Provisional Application No. 61/693,023, filed on Aug. 24, 2012. The disclosure of the above application is incorporated herein by reference in its entirety.

This application is related to U.S patent application Ser. No. 13/798,351 filed on Mar. 13, 2013, Ser. No. 13/798,586 filed on Mar. 13, 2013, Ser. No. 13/798,590 filed on Mar. 13, 2013, Ser. No. 13/798,536 filed on Mar. 13, 2013, Ser. No. 13/798,435 filed on Mar. 13, 2013, Ser. No. 13/798,471 filed on Mar. 13, 2013, Ser. No. 13/798,737 filed on Mar. 13, 2013, Ser. No. 13/798,701 filed on Mar. 13, 2013, Ser. No. 13/798,518 filed on Mar. 13, 2013, Ser. No. 13/799,129 filed on Mar. 13, 2013, Ser. No. 13/798,540 filed on Mar. 13, 2013, Ser. No. 13/798,574 filed on Mar. 13, 2013, Ser. No. 13/799,181 filed on Mar. 13, 2013, Ser. No. 13/799,116 filed on Mar. 13, 2013, Ser. No. 13/798,624 filed on Mar. 13, 2013, Ser. No. 13/798,384 filed on Mar. 13, 2013, Ser. No. 13/798,775 filed on Mar. 13, 2013, and Ser. No. 13/798,400 filed on Mar. 13, 2013. The entire disclosures of the above applications are incorporated herein by reference.

FIELD

The present disclosure relates to deactivating a cylinder of an engine and reactivating the cylinder based on an estimated mass of air trapped in the cylinder.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

Under some circumstances, one or more cylinders of an engine may be deactivated to decrease fuel consumption. For example, one or more cylinders may be deactivated when the engine can produce a requested amount of torque while the one or more cylinders are deactivated. Deactivation of a cylinder may include disabling opening intake and exhaust valves of the cylinder and disabling fueling of the cylinder.

SUMMARY

A system according to the principles of the present disclosure includes a cylinder activation module and a spark control module. The cylinder activation module selectively deactivates and reactivates a cylinder of an engine. The cylinder activation module deactivates the cylinder after intake air is drawn into the cylinder and before fuel is injected into the cylinder or spark is generated in the cylinder. When the cylinder is reactivated, the spark control module selectively controls a spark plug to generate spark in the cylinder before an intake valve or an exhaust valve of the cylinder is opened.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
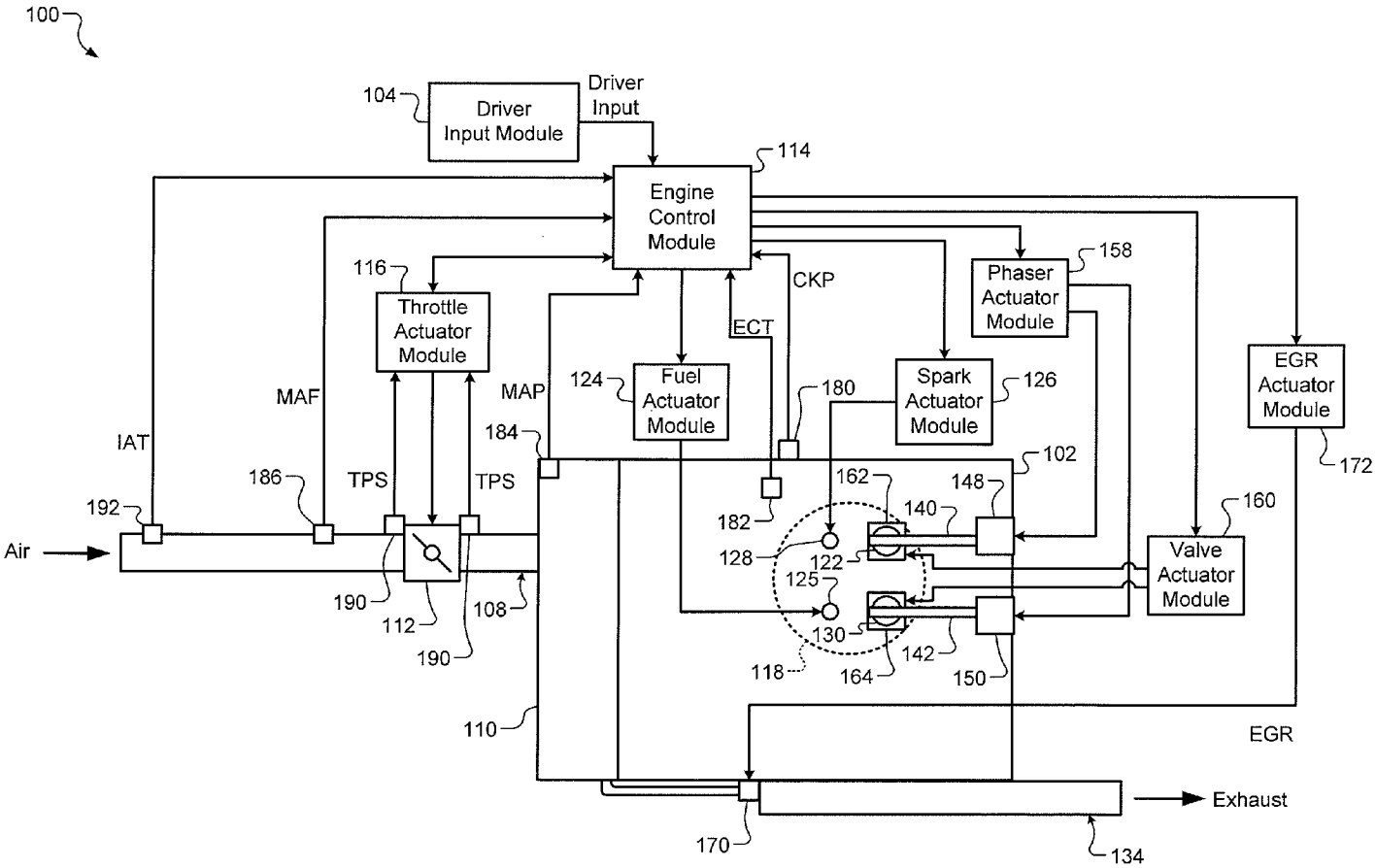
FIG. 1 is a functional block diagram of an example engine system according to the principles of the present disclosure.

An engine control system may deactivate a cylinder of an engine after an air/fuel mixture is combusted in the cylinder and before exhaust gas is expelled from the cylinder. As a result, all of the exhaust gas that results from combustion is trapped in the cylinder along with a small quantity of unburned fuel. The trapped gas may be referred to as a full burned charge. The trapped gas acts as a spring as a piston in the cylinder moves between its topmost position, referred to as top dead center (TDC), and its bottommost position, referred to as bottom dead center (BDC).

When the piston moves from BDC to TDC, the engine uses energy as the piston compresses the trapped gas. When the piston moves from TDC to BDC, the engine recoups some of the energy since the trapped gas biases the piston towards BDC. However, the engine does not recoup all of the energy, which results in a pumping loss that has a negative effect on fuel economy. In addition, the high pressure of the trapped gas results in engine vibrations as the piston moves within the cylinder, compressing and expanding the trapped gas.

An engine control system may deactivate a cylinder of an engine after exhaust gas is expelled from the cylinder and before an intake valve is opened to draw fresh air into the cylinder. As a result, residual exhaust and a small quantity of unburned fuel are trapped within the cylinder. The trapped gas may be referred to as a small burned charge. Trapping a small burned charge improves fuel economy and reduces engine vibrations relative to trapping a full burned charge. However, the pressure in the cylinder trapping the small burned charge may be less than the pressure in a crankcase of the engine. Thus, a vacuum may be created in the cylinder that causes crankcase oil to flow past piston rings and into the cylinder. Some of the crankcase oil may be combusted when the cylinder is reactivated.

An engine control system and method according to the principles of the present disclosure deactivates a cylinder of an engine after fresh air is drawn into the cylinder and before fuel is injected into the cylinder or spark is generated in the cylinder. As a result, fresh air, a small quantity of residual exhaust, and a small quantity of unburned fuel are trapped in the cylinder. Trapping fresh air improves fuel economy and reduces engine vibrations relative to trapping a full burned charge. In addition, the pressure in a cylinder containing fresh air is greater than the pressure in a cylinder containing a small burned charge. Thus, trapping fresh air reduces oil consumption relative to trapping a small burned charge.

An engine control system and method according to the principles of the present disclosure estimates the amount of fresh air, residual exhaust, and unburned fuel trapped in the cylinder when the cylinder is reactivated. If the estimated amount is sufficient for combustion, the cylinder is reactivated by injecting fuel into the cylinder and generating spark in the cylinder before opening the intake or exhaust valves. Thus, the cylinder is able to generate torque faster relative to other reactivation techniques.

Referring now to FIG. 1, an engine system 100 includes an engine 102 that combusts an air/fuel mixture to produce drive torque for a vehicle based on driver input from a driver input module 104. Air is drawn into the engine 102 through an intake system 108. The intake system 108 includes an intake manifold 110 and a throttle valve 112. The throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may selectively deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. A fuel injector 125 injects fuel directly into the cylinder 118 or into a mixing chamber associated with the cylinder 118. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to when the piston is at TDC.

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, the combustion of the air/fuel mixture drives the piston down, thereby driving the crankshaft. The combustion stroke corresponds to the piston moving down from TDC to BDC.

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114.

The ECM 114 may deactivate the cylinder 118 by instructing a valve actuator module 160 to deactivate opening of the intake valve 122 and/or the exhaust valve 130. The valve actuator module 160 deactivates opening of the intake valve 122 by actuating an intake valve actuator 162. The valve actuator module 160 deactivates opening of the exhaust valve 130 by actuating an exhaust valve actuator 164. In one example, the valve actuators 162, 164 include solenoids that deactivate opening of the valves 122, 130 by decoupling cam followers from the camshafts 140, 142. In this example, opening the valves 122, 130 may only be deactivated when the piston is at TDC and the cam followers are on the base circle of the cam lobe so that any load on the valve actuators 160, 162 is minimal to allow actuator movement.

In another example, the valve actuators 162, 164 are electromagnetic or electrohydraulic actuators that control the lift, timing, and duration of the valves 122, 130 independent from the camshafts 140, 142. In this example, opening of the valves 122, 130 may be deactivated anytime during the piston stroke. In addition, the camshafts 140, 142, the cam phasers 148, 150, and the phaser actuator module 158 may be omitted.

The engine system 100 may include an exhaust gas recirculation (EGR) valve 170, which selectively redirects exhaust gas back to the intake manifold 110. The EGR valve 170 may be controlled by an EGR actuator module 172.

The position of the crankshaft may be measured using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

Figure 2:
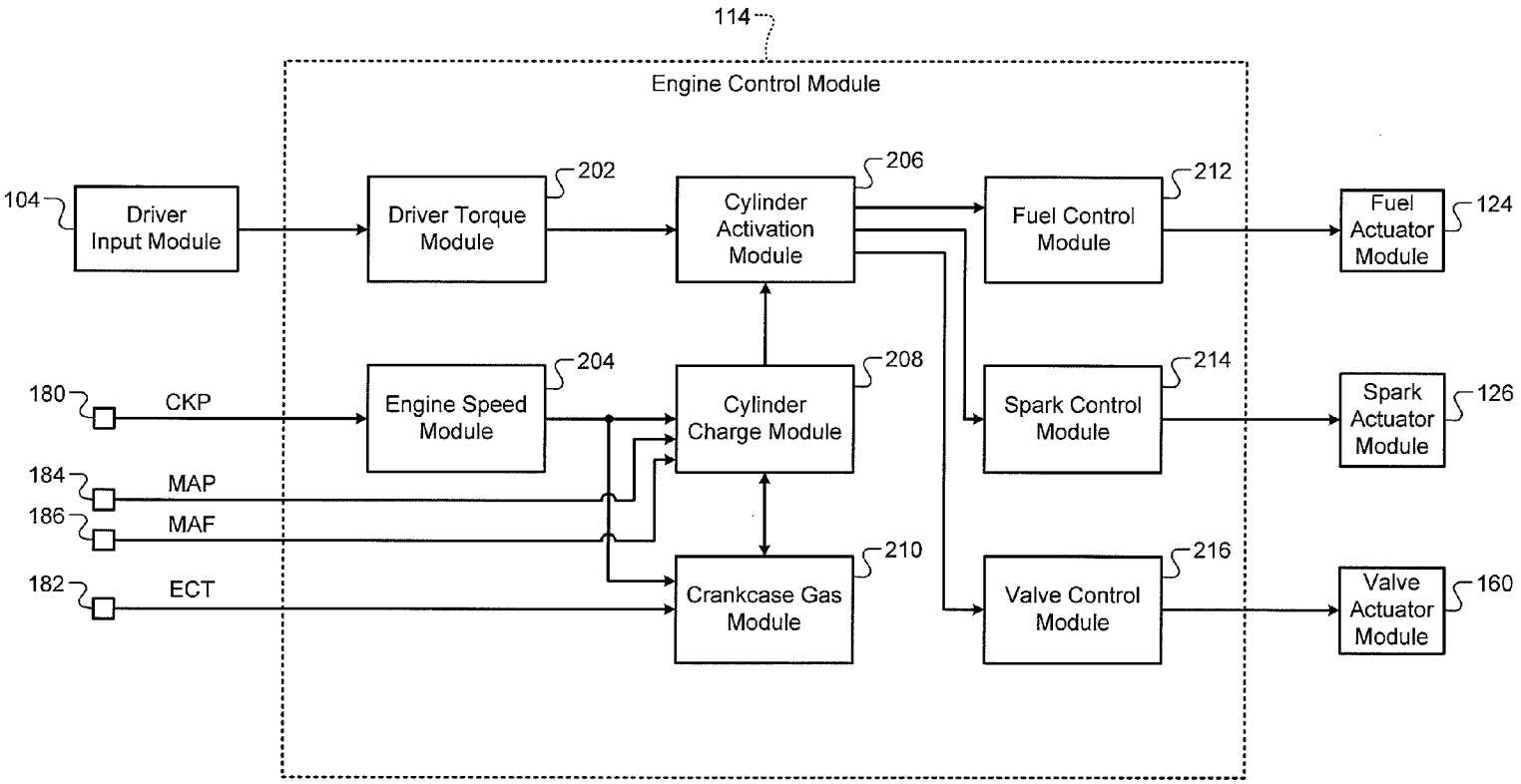
FIG. 2 is a functional block diagram of an example control system according to the principles of the present disclosure.

Referring now to FIG. 2, an example implementation of the ECM 114 includes a driver torque module 202, an engine speed module 204, a cylinder activation module 206, a cylinder charge module 208, and a crankcase gas module 210. The driver torque module 202 determines a driver torque request based on the driver input from the driver input module 104. The driver input may be based on a position of an accelerator pedal. The driver input may also be based on cruise control, which may be an adaptive cruise control system that varies vehicle speed to maintain a predetermined following distance. The driver torque module 202 may store one or more mappings of accelerator pedal position to desired torque, and may determine the driver torque request based on a selected one of the mappings. The driver torque module 202 outputs the driver torque request.

The engine speed module 204 determines engine speed. The engine speed module 204 may determine engine speed based on input received from the CKP sensor 180. The engine speed module 204 may determine engine speed based on an amount of crankshaft rotation between tooth detections and the corresponding period. The engine speed module 204 outputs the engine speed.

The cylinder activation module 206 deactivates and reactivates one or more cylinders of the engine 102 based on the driver torque request. The cylinder activation module 206 may deactivate one or more cylinders when the engine 102 can satisfy the driver torque request while the cylinder(s) are deactivated. The cylinder activation module 206 may reactivate one or more cylinders when the engine 102 cannot satisfy the driver torque request while the cylinder(s) are deactivated.

The cylinder activation module 206 deactivates the cylinder 118 by sending instructions to a fuel control module 212, a spark control module 214, and a valve control module 216. In turn, the fuel control module 212 instructs the fuel actuator 124 to stop injecting fuel into the cylinder 118 and the spark control module 214 instructs the spark actuator module 126 to stop generating spark in the cylinder 118. In addition, the valve control module 216 instructs the valve actuator module 160 to close the valves 122, 130 and/or to stop opening the valves 122, 130.

The cylinder activation module 206 may deactivate the cylinder 118 after intake air is drawn into the cylinder 118 and before the fuel injector 125 injects fuel into the cylinder 118 or the spark plug 128 generates spark in the cylinder 118. Deactivating the cylinder 118 at this time traps fresh intake air in the cylinder 118 while the cylinder 118 is deactivated. The cylinder activation module 206 may deactivate the cylinder 118 when the intake valve 122 is closed at the end of an intake stroke.

When the valve actuator 162 is an electromagnetic or electrohydraulic actuator, the cylinder activation module 206 may close the intake valve 122 and deactivate the cylinder 118 before the intake stroke is complete. The time at which the intake valve 122 is closed may be adjusted to control the amount of air trapped in the cylinder 118. The amount of air trapped in the cylinder 118 may be controlled to minimize the pressure within the cylinder 118 while ensuring that there is enough air in the cylinder 118 to allow adequate combustion and to prevent crankcase oil from entering the cylinder 118. Minimizing the pressure within the cylinder 118 reduces the pumping losses associated with the cylinder 118 while the cylinder 118 is deactivated, which improves the fuel economy of the engine 102.

The cylinder charge module 208 estimates a mass of a charge within a cylinder of the engine 102. The cylinder charge may include intake air, unburned fuel, and/or exhaust. The cylinder charge module 208 may estimate the mass of the charge in each cylinder of the engine 102 once per engine cycle.

The cylinder charge module 208 may estimate the mass of the charge trapped in the cylinder 118 when the intake valve 122 is closed and the cylinder 118 is deactivated. Thus, the cylinder charge may include air, unburned fuel, and residual exhaust. The cylinder charge module 208 may estimate the mass of each component of the cylinder charge. The cylinder charge module 208 may estimate the mass of air initially trapped in the cylinder 118 based on the manifold pressure, the mass flow rate of intake air, the engine speed, the throttle area, and/or the cam phaser positions.

When the cylinder 118 is deactivated, the cylinder charge module 208 adjusts the estimated mass of the cylinder charge as the piston moves between TDC and BDC. As the piston moves from BDC to TDC, the pressure within the cylinder 118 increases relative to the pressure within a crankcase of the engine 102. This causes a portion of the cylinder charge to flow past piston rings and to the crankcase, referred to as blow-by. Thus, the estimated mass of the cylinder charge may be decreased. As the piston moves from TDC to BDC, the cylinder pressure decreases relative to the crankcase pressure. This causes a portion of the crankcase gas to flow past the piston rings and into the cylinder 118. Thus, the estimated mass of the cylinder charge may be increased.

The crankcase gas module 210 estimates the mass of gas within the crankcase. The crankcase gas module 210 may estimate the mass of the crankcase gas when the intake valve 122 is closed and the cylinder 118 is deactivated. At this time, the cylinder charge is primarily made up of air. Thus, the crankcase gas module 210 may estimate the mass of the crankcase gas based on the estimated mass of air trapped in the cylinder 118 without considering the mass of the other constituents of the cylinder charge.

In addition, the crankcase gas module 210 may estimate the mass of the crankcase gas based on the engine speed, the engine coolant temperature, and/or the pressure in the crankcase. The mass of the crankcase gas may be estimated based on the engine coolant temperature since the amount of flow past the piston rings increases as the engine temperature decreases and the effectiveness of the piston ring seal decreases. The crankcase gas module 210 may estimate the crankcase pressure based on the amount of flow past the piston rings and/or the amount of flow through a pressure relief valve. The pressure relief valve releases gas from the crankcase when the crankcase pressure is greater than a predetermined pressure. The release gas is directed to the intake system 108.

The cylinder activation module 206 reactivates the cylinder 118 by sending instructions to the fuel control module 212, the spark control module 214, and the valve control module 216. In turn, the fuel control module 212 instructs the fuel actuator 124 to resume injecting fuel into the cylinder 118 and the spark control module 214 instructs the spark actuator module 126 to resume generating spark in the cylinder 118. In addition, the valve control module 216 instructs the valve actuator module 160 to resume opening the valves 122, 130.

The cylinder activation module 206 may reactivate the cylinder 118 in a number of ways. The cylinder activation module 206 may open the intake valve 122 first, before opening the exhaust valve 130 or injecting fuel into the cylinder 118 and generating spark in the cylinder 118. The cylinder activation module 206 may open the exhaust valve 130 first, before opening the intake valve 122 or injecting fuel into the cylinder 118 and generating spark in the cylinder 118. The cylinder activation module 206 may inject fuel into the cylinder 118 and generate spark in the cylinder 118 first, before opening the valves 122, 130.

The cylinder activation module 206 opens the intake valve 122 first when a maximum pressure in the cylinder 118 is less than a first pressure, indicating that a minimal amount of charge will be pushed back to the intake manifold 110 if the intake valve 122 is opened. The maximum pressure is the pressure in the cylinder 118 when the piston is at TDC. The maximum pressure may be estimated based on the volume, temperature, and mass of the charge trapped in the cylinder 118. The first pressure may be a predetermined value (e.g., 5 kilopascals).

If the maximum pressure is greater than or equal to the first pressure, the cylinder activation module 206 compares the estimated mass of air trapped within the cylinder 118 to a first mass. The first mass may be a predetermined value (e.g., 50 milligrams). The cylinder activation module 206 injects fuel into the cylinder 118 and generates spark in the cylinder 118 first when the estimated mass of trapped air is greater than the first mass, indicating that the trapped air mass is adequate for combustion. The cylinder activation module 206 opens the exhaust valve 130 first when the estimated mass of trapped air is less than or equal to the first mass.

When the cylinder activation module 206 injects fuel into the cylinder 118 and generates spark in the cylinder 118 first, the cylinder activation module 206 opens the exhaust valve 130 to expel exhaust before opening the intake valve 122 to draw in fresh intake air. In this regard, the cylinder activation module 206 reactivates the exhaust valve 130 first. Similarly, the cylinder activation module 206 deactivates the exhaust valve 130 first since the exhaust valve 130 is the first of the valves 122, 130 that is not opened normally when the cylinder 118 is deactivated. Since the cylinder activation module 206 may deactivate and reactivate the same valve (i.e., the exhaust valve 130) first, only one solenoid may be required to deactivate and reactivate the cylinder 118. Thus, if the valve actuators 162, 164 include solenoids, one of the valve actuators 162, 164 may be omitted, which reduces vehicle costs.

Figure 3:
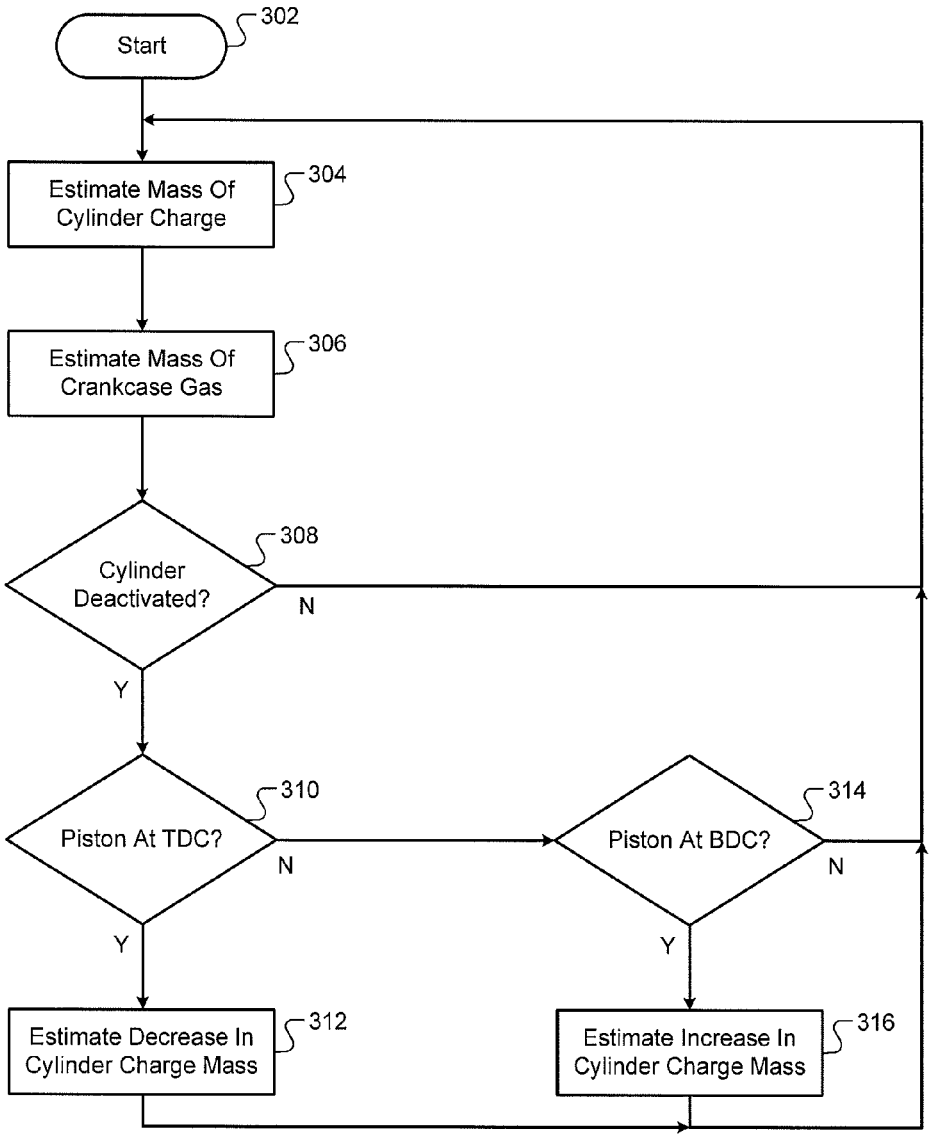
FIGS. 3 and 4 are flowcharts illustrating an example control method according to the principles of the present disclosure.

Referring now to FIG. 3, a method for estimating a mass of a charge within a cylinder begins at 302. The cylinder charge may include intake air, unburned fuel, and/or exhaust. The method may estimate the mass of the charge in each cylinder of an engine once per engine cycle.

At 304, the method estimates the mass of the cylinder charge. The method may estimate the mass of a charge trapped in a cylinder when an intake valve of the cylinder is closed after a piston in the cylinder completes an intake stroke. Thus, the cylinder charge may include trapped air, unburned fuel, and residual exhaust. The method may estimate the mass of each component of the cylinder charge. The method may estimate the mass of air trapped in the cylinder based on a manifold pressure, a mass flow rate of intake air, engine speed, a throttle area, and/or cam phaser positions.

At 306, the method estimates the mass of gas within a crankcase of the engine. The method may estimate the mass of the crankcase gas based on the estimated mass of air trapped in the cylinder, the engine speed, an engine coolant temperature, and/or the pressure in the crankcase. The method may estimate the crankcase pressure based on the amount of flow past piston rings and/or the amount of flow through a pressure relief valve that selectively releases gas from the crankcase based on the crankcase pressure.

At 308, the method determines whether the cylinder is deactivated. If the cylinder is deactivated, the method continues at 310. Otherwise, the method continues at 304. At 310 through 316, the method estimates changes in the estimated mass of the charge trapped in the deactivated cylinder and the estimated mass of the gas in the crankcase as gas is exchanged between the cylinder and the crankcase due to blow-by.

The method may estimate changes in the estimated mass of the charge trapped in the deactivated cylinder and the estimated mass of the gas in the crankcase based on the amount of flow past the piston rings. The method may estimate the amount of flow past the piston rings using a theoretical model and/or an empirical model. The theoretical model may be used to estimate the amount of flow past the piston rings based on an effective orifice size and a pressure difference. The effective orifice size is the size of the gap between the piston rings and the piston bore. The effective orifice size may be determined based on the engine geometry and engine operating conditions such as the engine coolant temperature.

The pressure difference is the difference between the crankcase pressure and the cylinder pressure. The crankcase pressure may be estimated as described above. The cylinder pressure may be estimated based on the volume of the cylinder and the temperature and mass of the cylinder charge. The cylinder volume may be determined based on the engine geometry. The cylinder pressure may be estimated based on the estimated mass of the trapped cylinder charge from a previous iteration.

The empirical model may be developed by measuring the crankcase pressure and the cylinder pressure to determine the amount of flow past the piston rings under various engine operating conditions. The crankcase pressure and the cylinder pressure may be measured when an engine is mounted to a dynamometer in a laboratory. A relationship between the crankcase pressure, the cylinder pressure, and the engine operating conditions may be captured in the form of an equation and/or a lookup table.

The empirical model may also be used to estimate the mass of air trapped in the cylinder. When a cylinder is initially deactivated, the mass of air trapped in the cylinder may be estimated based on engine operating parameters such as the mass flow rate of intake air, the engine speed, the throttle area, and/or cam phaser positions. However, as the cylinder is deactivated, the mass of air trapped in the cylinder, and the portion of the cylinder charge that is made up of air, changes due to blow-by.

The empirical model for estimating the mass of air trapped in the cylinder may be developed by injecting fuel into the cylinder after the cylinder has been deactivated for a predetermined number (e.g., 3) of engine cycles. The fuel may then be combusted and exhausted, and the air/fuel ratio of the exhaust may be measured. The amount of air trapped in the cylinder after the predetermined number of engine cycles may then be determined based on the amount of fuel injected and the measured air/fuel ratio. Engine operating conditions may be measured while the empirical model is developed, and a relationship between the engine operating conditions and the mass of air trapped in the cylinder may be captured in the form of an equation and/or a lookup table.

At 310, the method determines whether the piston is at TDC. If the piston is at TDC, the method continues at 312. Otherwise, the method continues at 314. At 312, the method estimates a decrease in the mass of the trapped cylinder charge.

At 314, the method determines whether the piston is at BDC. If the piston is at BDC, the method continues at 316. Otherwise, the method continues at 304. At 316, the method estimates an increase in the mass of the trapped cylinder charge.

For simplicity, FIG. 3 illustrates a method for estimating the mass of a charge in one cylinder of an engine. However, the method depicted in FIG. 3 may be repeated for each cylinder in an engine. In addition, the mass of the crankcase gas may be adjusted based on the estimated mass of the charge in each cylinder of an engine.

Figure 4:
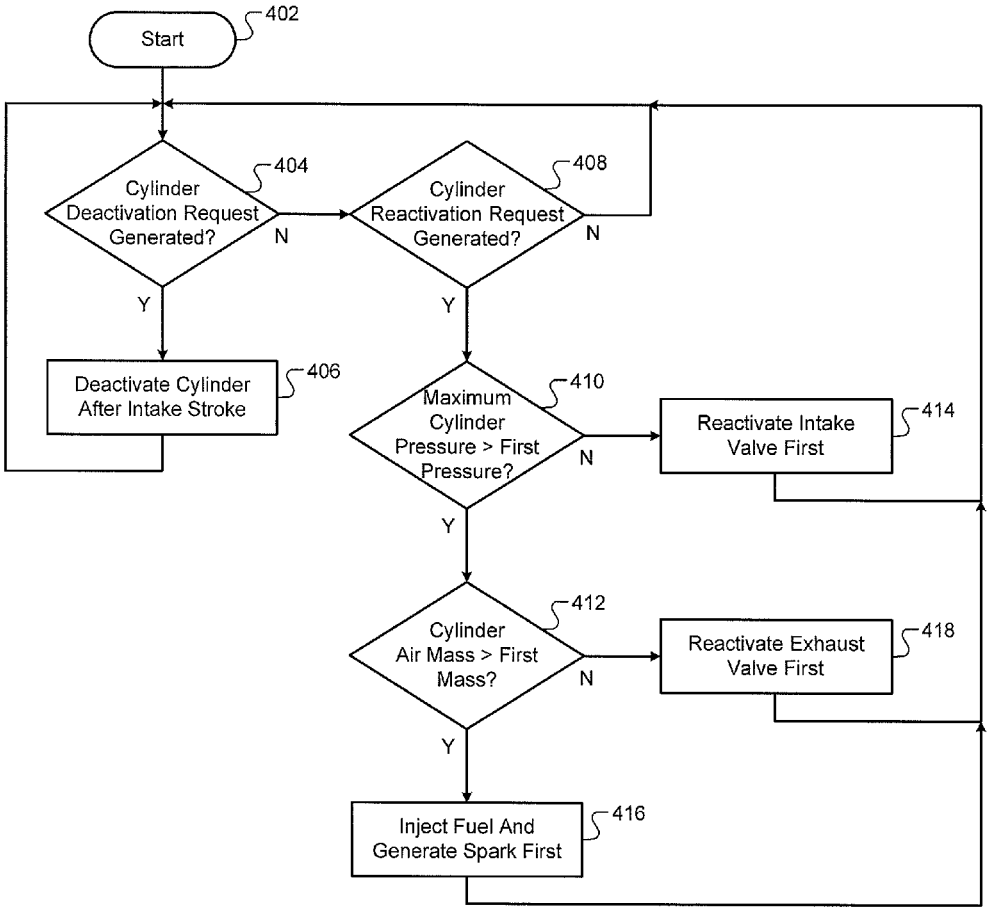

Referring now to FIG. 4, a method for deactivating a cylinder of an engine and reactivating the cylinder based on an estimated mass of air trapped in the cylinder begins at 402. At 404, the method determines whether a cylinder deactivation request is generated. In various implementations, a cylinder deactivation request is generated when the engine can produce a requested amount of torque while the one or more cylinders of the engine are deactivated. If a cylinder deactivation request is generated, the method continues at 406. Otherwise, the method continues at 408.

At 406, the method deactivates the cylinder after a piston in the cylinder completes an intake stroke and an intake valve of the cylinder is closed, and before an exhaust valve of the cylinder is opened. This traps fresh intake air within the cylinder as the cylinder is deactivated.

The method may close the intake valve and deactivate the cylinder before the intake stroke is complete when, for example, the intake valve is controlled using a valve actuator such as an electromagnetic or electrohydraulic actuator. The time at which the intake valve is closed may be adjusted to control the amount of air trapped in the cylinder. The amount of air trapped in the cylinder may be controlled to minimize the pressure within the cylinder while ensuring that there is enough air in the cylinder to allow adequate combustion and to prevent crankcase oil from entering the cylinder.

At 408, the method determines whether a cylinder reactivation request is generated. In various implementations, a cylinder reactivation request is generated when the engine cannot produce a requested amount of torque while the one or more cylinders of the engine are deactivated. If a cylinder reactivation request is generated, the method continues at 410. Otherwise, the method continues at 404.

At 410, the method determines whether a maximum pressure in the cylinder is greater than or equal to a first pressure. The maximum pressure in the cylinder may be the pressure in the cylinder when the piston is at TDC. The maximum pressure may be estimated based on the volume, composition, temperature, and mass of the trapped cylinder charge. The mass of the trapped cylinder charge may be estimated as described above with reference to FIG. 3. The first pressure may be a predetermined value (e.g., 5 kilopascals). If the maximum pressure is greater than or equal to the first pressure, the method continues at 412. If the maximum pressure is less than the first pressure, indicating that a minimal amount of charge will be pushed back to an intake manifold of the engine if the intake valve is opened, the method continues at 414.

At 414, the method reactivates the intake valve first, before reactivating the exhaust valve or injecting fuel into the cylinder and generating spark in the cylinder. In other words, the method draws air into the cylinder before exhausting the charge from the cylinder or injecting fuel into the cylinder and generating spark in the cylinder.

At 412, the method determines whether the mass of air trapped in the cylinder is greater than a first mass. The mass of air trapped in the cylinder may be estimated as described above with reference to FIG. 3. The first mass may be a predetermined value (e.g., 50 milligrams). If the mass of air trapped in the cylinder is greater than the first mass, the method continues at 416. Otherwise, the method continues at 418.

At 418, the method reactivates the exhaust valve first, before reactivating the intake valve or injecting fuel into the cylinder and generating spark in the cylinder. In other words, the method exhausts the charge from the cylinder before drawing air into the cylinder or injecting fuel into the cylinder and generating spark in the cylinder.

At 416, the method first injects fuel into the cylinder and generates spark in the cylinder before reactivating the intake valve or the exhaust valve. In other words, the method injects fuel into the cylinder and generates spark in the cylinder before drawing air into the cylinder or exhausting the charge from the cylinder.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A system comprising:

a cylinder activation module that:

selectively deactivates and reactivates a cylinder of an engine; and deactivates the cylinder after intake air is drawn into the cylinder and before fuel is injected into the cylinder or spark is generated in the cylinder, wherein deactivating the cylinder includes closing and disabling an intake valve of the cylinder and an exhaust valve of the cylinder for multiple engine cycles while at least one other cylinder of the engine is active; and a spark control module that, when the cylinder is reactivated, selectively controls a spark plug to generate spark in the cylinder before the intake valve or the exhaust valve of the cylinder is opened.

2. The system of claim 1 further comprising a fuel control module that, when the cylinder is reactivated, selectively controls a fuel injector to inject fuel into the cylinder before the intake valve or the exhaust valve is opened and before spark is generated in the cylinder.

3. The system of claim 2 wherein the spark control module selectively generates spark in the cylinder before the intake valve or the exhaust valve is opened when a pressure in the cylinder is greater than a first pressure.

4. The system of claim 3 wherein the cylinder activation module estimates the pressure in the cylinder based on a volume, a temperature, and a mass of a charge trapped within the cylinder when the cylinder is deactivated.

5. The system of claim 3 wherein the spark control module generates spark in the cylinder before the intake valve or the exhaust valve is opened when a mass of air within the cylinder is greater than a first mass.

6. The system of claim 5 further comprising a cylinder charge module that estimates a mass of a charge, including the mass of air, trapped within the cylinder when the cylinder is deactivated.

7. The system of claim 6 wherein the cylinder charge module estimates the mass of air trapped within the cylinder when the cylinder is deactivated based on at least one of a manifold pressure, a mass flow rate of intake air, engine speed, a throttle area, and cam phaser positions.

8. The system of claim 6 wherein the cylinder charge module adjusts the estimated mass of the charge based on an amount of flow between the cylinder and a crankcase of the engine as a piston moves within the cylinder when the cylinder is deactivated.

9. The system of claim 8 wherein the cylinder charge module estimates the amount of flow between the cylinder and the crankcase based on a position of the piston and a mass of gas trapped within the crankcase when the cylinder is deactivated.

10. The system of claim 9 further comprising a crankcase gas module that estimates the mass of gas trapped within the crankcase based on at least one of engine speed, an engine coolant temperature, and a pressure in the crankcase.

11. A method comprising:

selectively deactivating and reactivating a cylinder of an engine; and deactivating the cylinder after intake air is drawn into the cylinder and before fuel is injected into the cylinder or spark is generated in the cylinder, wherein deactivating the cylinder includes closing and disabling an intake valve of the cylinder and an exhaust valve of the cylinder for multiple engine cycles while at least one other cylinder of the engine is active; and when the cylinder is reactivated, selectively controlling a spark plug to generate spark in the cylinder before the intake valve or the exhaust valve of the cylinder is opened.

12. The method of claim 11 further comprising, when the cylinder is reactivated, selectively controlling a fuel injector to inject fuel into the cylinder before the intake valve or the exhaust valve is opened and before spark is generated in the cylinder.

13. The method of claim 12 further comprising selectively generating spark in the cylinder before the intake valve or the exhaust valve is opened when a pressure in the cylinder is greater than a first pressure.

14. The method of claim 13 further comprising estimating the pressure in the cylinder based on a volume, a temperature, and a mass of a charge trapped within the cylinder when the cylinder is deactivated.

15. The method of claim 13 further comprising generating spark in the cylinder before the intake valve or the exhaust valve is opened when a mass of air within the cylinder is greater than a first mass.

16. The method of claim 15 further comprising estimating a mass of a charge, including the mass of air, trapped within the cylinder when the cylinder is deactivated.

17. The method of claim 16 further comprising estimating the mass of air trapped within the cylinder when the cylinder is deactivated based on at least one of a manifold pressure, a mass flow rate of intake air, engine speed, a throttle area, and cam phaser positions.

18. The method of claim 16 further comprising adjusting the estimated mass of the charge based on an amount of flow between the cylinder and a crankcase of the engine as a piston moves within the cylinder when the cylinder is deactivated.

19. The method of claim 18 further comprising estimating the amount of flow between the cylinder and the crankcase based on a position of the piston and a mass of gas trapped within the crankcase when the cylinder is deactivated.

20. The method of claim 19 further comprising estimating the mass of gas trapped within the crankcase based on at least one of engine speed, an engine coolant temperature, and a pressure in the crankcase.

* * * * *